United States Patent [19]

Sutton

[11] Patent Number: 4,488,705

[45] Date of Patent: Dec. 18, 1984

[54] JACKING APPARATUS

[76] Inventor: John R. Sutton, P.O. Box 32, Beaumont, Tex. 77704

[21] Appl. No.: 306,366

[22] Filed: Sep. 28, 1981

[51] Int. Cl.[3] ..... B66F 1/00

[52] U.S. Cl. ..... 254/108

[58] Field of Search ..... 254/105-111; 405/196-198

[56] References Cited

U.S. PATENT DOCUMENTS

| | | | |
|---|---|---|---|
| 2,932,486 | 4/1960 | Suderow | 254/112 |
| 3,372,907 | 3/1968 | Smulders et al. | 254/110 |
| 3,722,863 | 3/1973 | Itoh et al. | 254/105 |
| 3,967,457 | 7/1976 | Lovie | 405/197 |
| 4,277,051 | 7/1981 | Lucas | 254/106 |

*Primary Examiner*—Robert C. Watson

*Attorney, Agent, or Firm*—Burns, Doane, Swecker & Mathis

[57] ABSTRACT

The present invention relates to a jacking apparatus for effecting relative vertical movement between an upright leg and a platform. The jacking apparatus includes a frame having at least two generally vertical parallel side rails. A carrier arranged adjacent the upright leg is movably carried along the frame by fluid cylinders for vertical movement relative to the rails. First and second elongated jack tracks are fixedly secured in a generally vertical orientation to the upright leg. Each of the jack tracks is received within a correspondingly shaped recess in the carrier. Each of the jack tracks further includes a plurality of regularly spaced openings extending completely through the jack track in a direction generally along the circumference of the leg. First and second pins supported by the carrier are selectively engaged in an aligned one of the openings in the first and second jack tracks to prevent vertical movement of the carrier relative to the leg. Each of the pins has a width which exceeds the width of the opening of the jack track in a circumferential direction of the leg. According to a further aspect of the present invention, three fluid cylinders are operably connected between the platform and the carrier for effecting movement of the carrier. The three fluid cylinders are arranged to partially surround the leg such that imaginary lines joining centers of the cylinders form an isosceles triangle. The base of the triangle is bisected by an imaginary line passing through the apex of the triangle and a central axis of the leg.

19 Claims, 14 Drawing Figures

Fig. 1
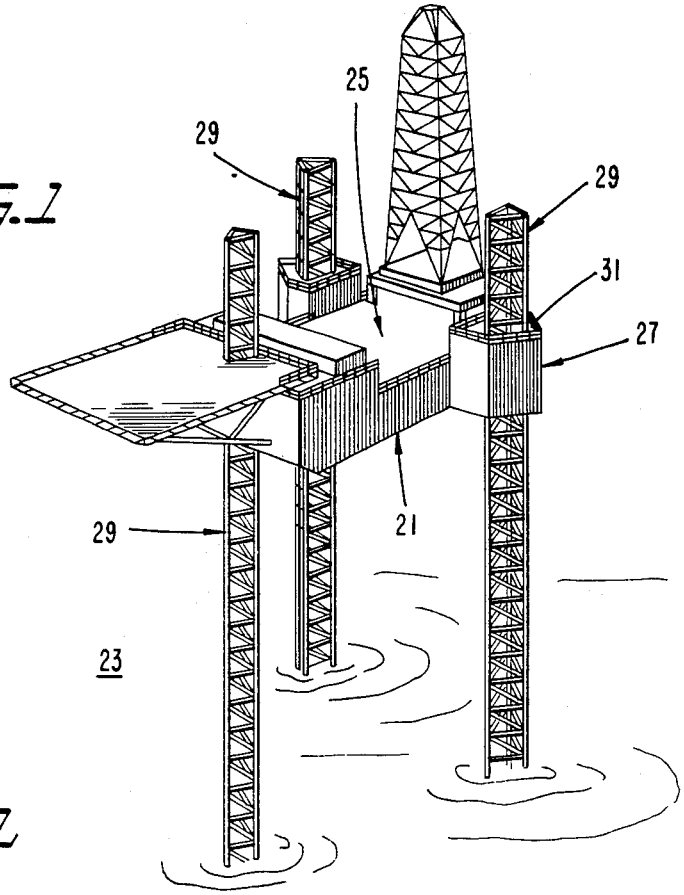
Fig. 2
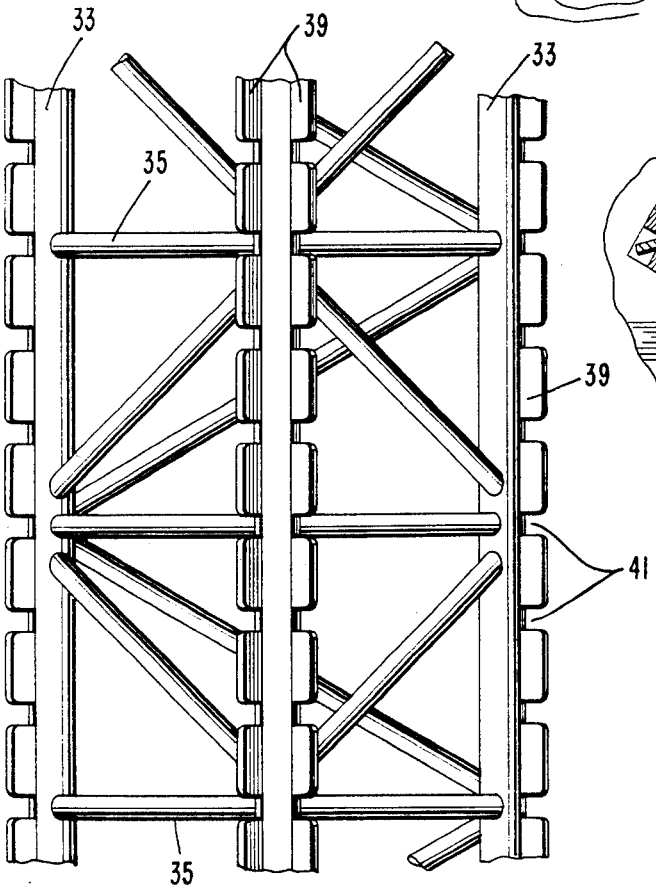
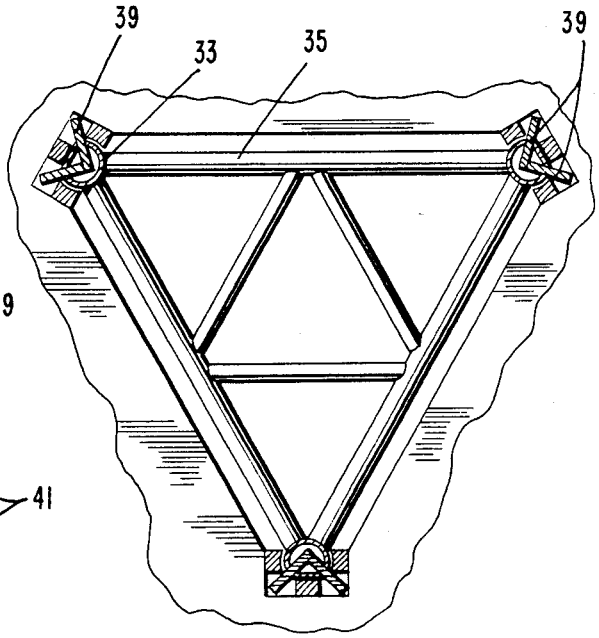
Fig. 3

Fig. 6
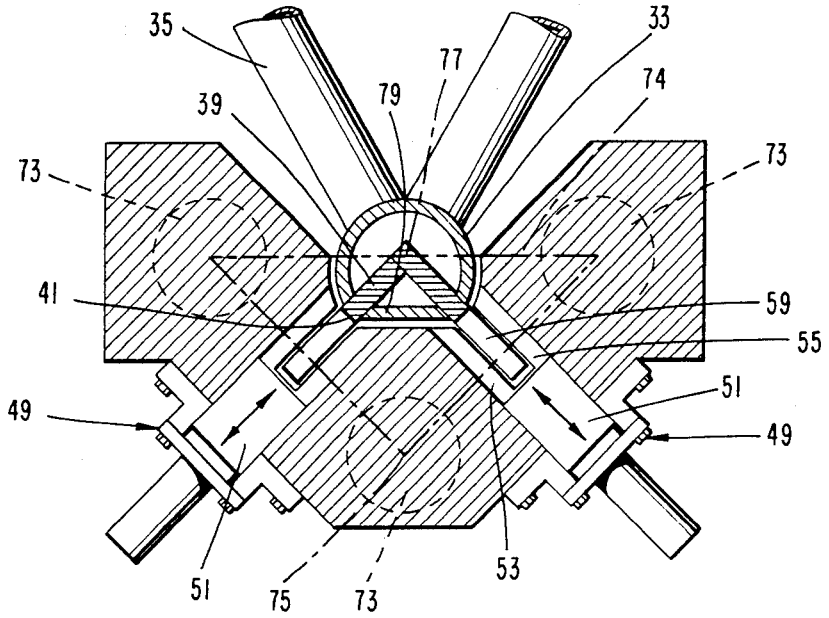
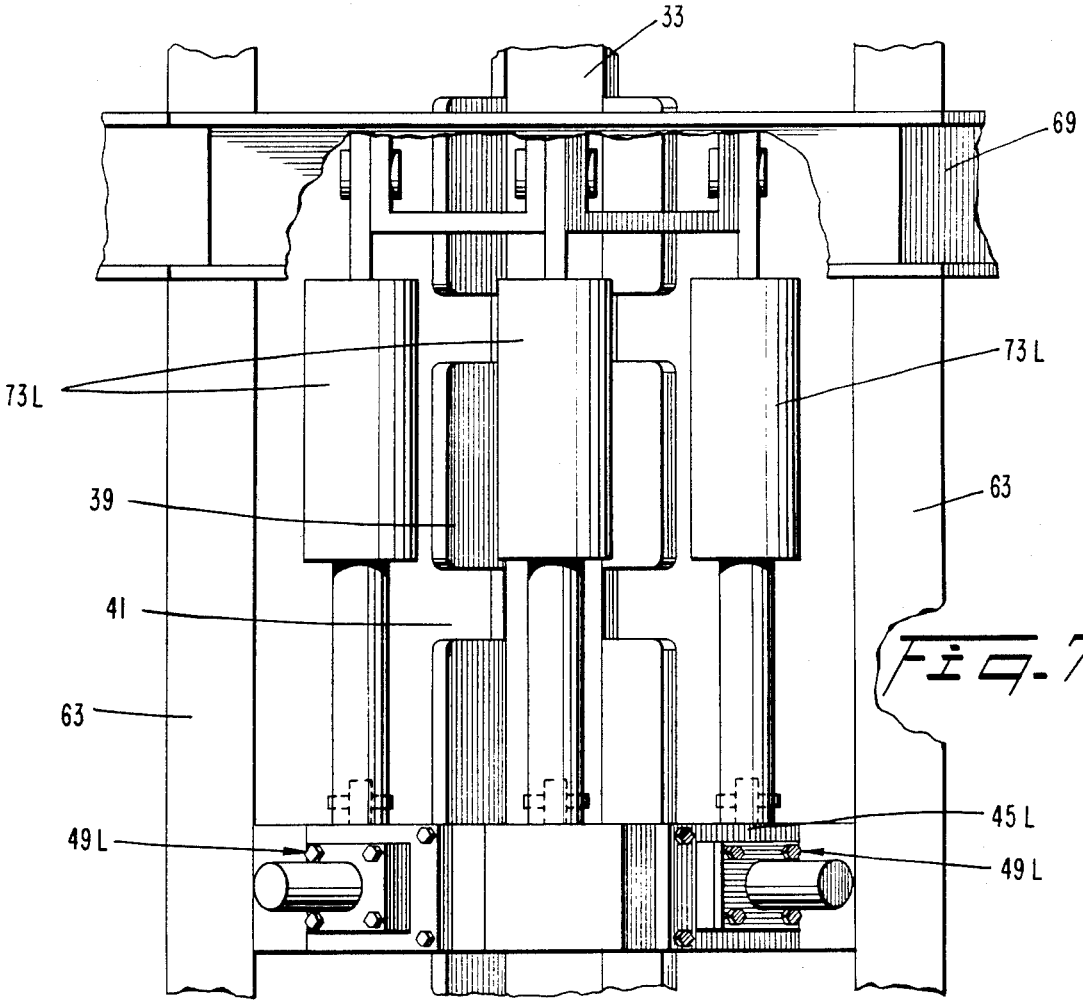
Fig. 7

Fig. 12
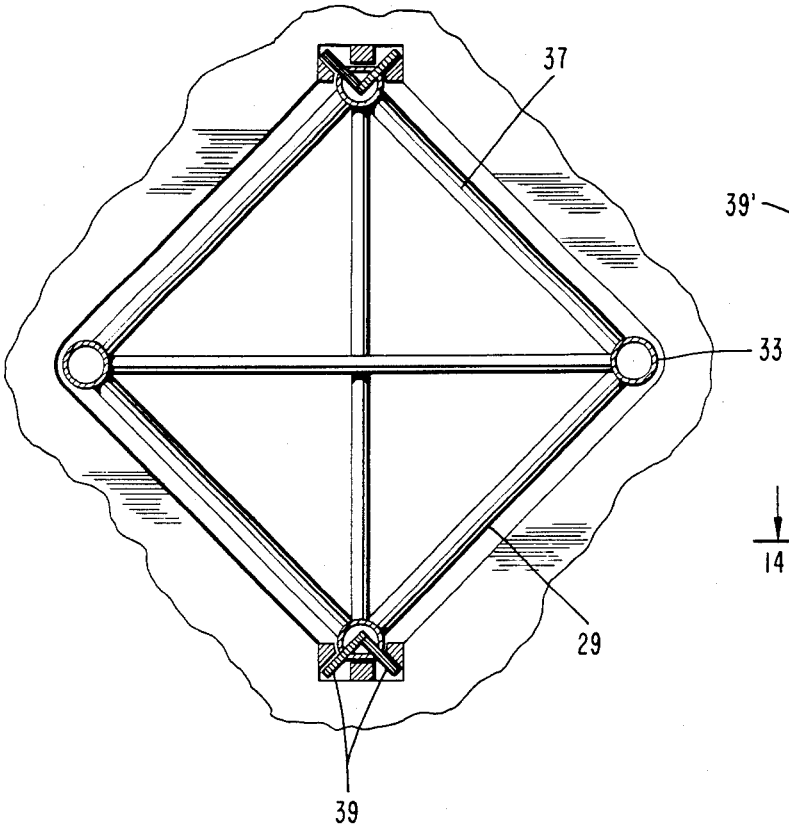
Fig. 14
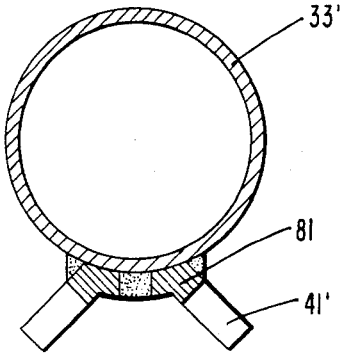
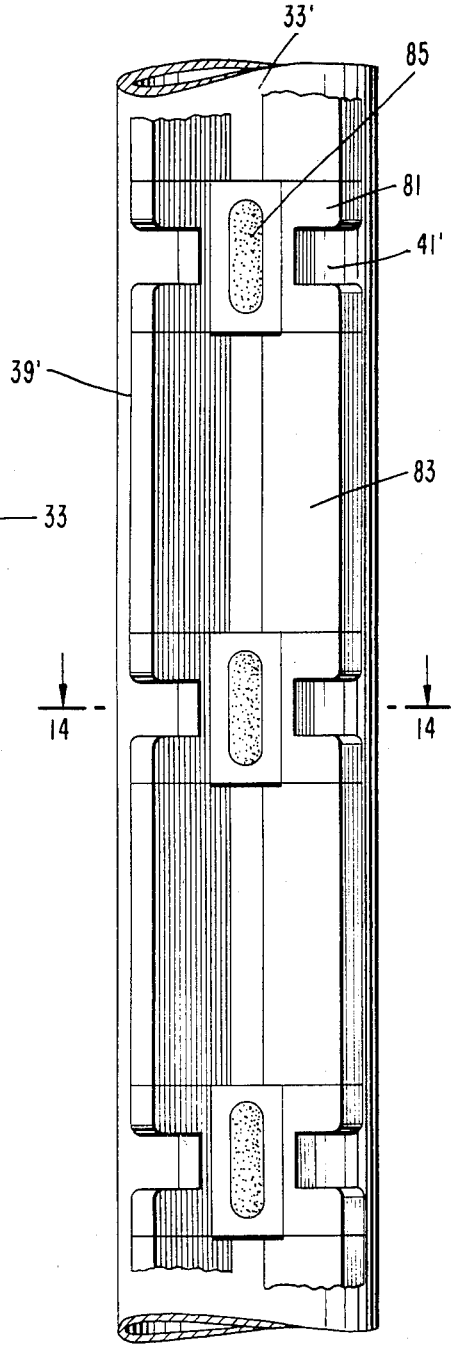
Fig. 13

JACKING APPARATUS

BACKGROUND AND SUMMARY OF THE PRESENT INVENTION

The present invention relates to an improved jacking apparatus. More particularly, the present invention relates to an improved jacking apparatus for an offshore platform to effect relative movement between the platform and platform supporting legs.

Offshore platforms are customarily employed for supporting oil drilling equipment or servicing equipment above open expanses of water. It is desirable for the platform to be elevated above the water surface so as to be relieved of the effects of wave action. The platform is generally mounted on a plurality of supporting legs which are lowered to the water bed for support. Subsequently the platform is raised along the supporting legs to an elevated position above the water surface for effecting the necessary offshore operations. A jacking mechanism is employed on the platform for lowering the legs to the water bed and raising the platform along the legs, i.e., effecting relative vertical movement between the platform and the legs.

Numerous forms of jacking mechanisms or apparatus have been proposed. One such mechanism is disclosed in my earlier U.S. Pat. No. 3,604,683 issued Sept. 14, 1971. In this patent, the jacking mechanism combines the action of hydraulic cylinders with a power driven threaded screw to effect climbing relative to a leg of a platform. Hydraulic cylinders are mounted at one end to a suitable support secured to the platform and at the opposite end to a movable carrier head having a pin connection selectively engagable with the leg. The pin connection operates in conjunction with a track along which the carrier head travels. Movement of the carrier head is supplemented by the action of a threaded screw which acts primarily as a safety feature.

A further jacking mechanism is described in my earlier U.S. Pat. No. 3,517,910 issued June 30, 1970. In this arrangement, each jacking assembly includes a yoke spaced from the deck of the platform and slidably mounted upon a supporting leg. An engagement pin is provided on the yoke which pin can be selectively engaged within a bore provided in a solid rectangular track preferably welded to an outside surface of the leg. The pin must be extended outwardly a substantial distance from the yoke to engage the bore or recess in the track. With such an arrangement, there is a substantial bending moment upon the pin when the pin is engaged within the bore. At least one jack comprising a threaded rod of a ball screw type is extensible and retractable for moving the yoke.

Still a further jacking mechanism is disclosed in my prior U.S. Pat. No. 4,007,914 issued Feb. 15, 1977. The jacking apparatus comprises a frame which includes a cross member mounted on the platform. Vertically spaced first and second fluid cylinders are carried by the platform with the first cylinder being mounted on the cross member. Each fluid cylinder carries a beam and a holding device for selectively coupling the beam to the leg. The cylinders and the holding devices are operated 180° out of phase to effect step-by-step movement of the platform relative to the leg. The holding device includes a hydraulically actuated pin which is adapted to fit within recesses or openings provided directly within the support leg of the platform. Due to the distance between the holding pin and the leg, and also the line contact between the holding pin and the recess in the leg, a substantial bending force is exerted upon the holding pin.

Further jacking mechanisms are disclosed in my other prior U.S. Pat. Nos. 3,804,369 issued Apr. 16, 1974 and 4,203,576 issued May 21, 1980.

In addition, it has been proposed to use a toothed rack secured along a longitudinal length of the leg. A rotatable pinion cooperates with the toothed rack to move the platform relative to the leg. It is submitted that such a rack and pinion arrangement requires a substantial expense in machining the teeth of the rack to withstand the high loads to which the teeth are subjected. In addition, it is submitted that such an arrangement requires a large amount of power to produce the desired amount of movement between the leg and the platform.

Notwithstanding the novel features and significant advantages of my previously patented systems, there remains room for improvement. In particular, it is desirable to produce a jacking mechanism which is both relatively simple in operation and comparatively inexpensive to produce. Further, it is desirable to provide a jacking mechanism which more efficiently distributes the forces generated during jacking whereby parts of the jacking mechanism can be manufactured from less expensive steels or other materials.

Accordingly, it is an object of the present invention to provide an improved jacking apparatus for effecting relative movement between a platform and supporting legs carried by the platform.

A further object of the present invention is to provide a jacking apparatus which can be operated substantially continuously with only minor interruptions during the jacking operation.

It is still a further object of the present invention to provide a jacking apparatus that reduces the stresses occurring on a holding mechanism for the jacking apparatus. In addition, it is an object of the present invention to reduce the forces exerted upon the supporting leg of the platform.

These objects and others are accomplished by a jacking apparatus according to the present invention for effecting relative vertical movement between an upright leg and a platform. The apparatus includes a frame for mounting on the platform which frame includes at least two generally vertical side rails. A carrier is mounted on the frame adjacent to the upright leg for vertical movement relative to the rails. Fluid cylinders operably connected between the platform and the carrier effect movement of the carrier relative to the rails. First and second elongated jack tracks fixedly secured in a generally vertical orientation to the upright leg are provided with each of the jack tracks being received within a correspondingly shaped recess in the carrier. Each of the jack tracks includes a plurality of regularly spaced openings extending completely through the jack track in a direction generally along the circumference of the leg. First and second holding mechanisms supported by the carrier are adapted to selectively engage an aligned one of the openings in the first and second jack tracks respectively to prevent vertical movement of the carrier relative to the leg. Each of the holding mechanisms has a width which exceeds a width of the opening in the jack track in the circumferential direction of the leg.

In the preferred embodiment, the first and second jack tracks are arranged at an angle of substantially 90° relative to one another. Further in a preferred embodiment, each of the holding mechanisms comprises a pin movably mounted within a cylinder supported by the carrier. The cylinder includes the recess and extends to a location closely adjacent an outer circumferential surface of the leg. The sliding tolerences between the recesses in the carrier and the corresponding jack track is preferably very small.

In a first embodiment, the leg comprises an elongated generally cylindrical column having a longitudinal opening therein. One of the jack tracks is fixedly secured to each side of the opening. A reinforcement plate is preferably fixedly secured between the two jack tracks arranged within the opening for stability and to further strengthen the assembly.

In a further embodiment of the present invention, the two jack tracks are fixedly secured to one another and fixedly secured to an outside circumference of the leg. The jack tracks may be formed as a continuous member or, alternatively, may be comprised of a plurality of individual sections fixedly secured to an outside surface of the leg and forming a continuous uninterrupted vertical track along the leg.

Since the width of the pin is greater than the width of the opening in the jack track, a generally U-shaped shear line exists when the pin engages the jack track opening. In this way, the shear stress is distributed over a larger surface area and the bending moment on the pin is substantially reduced. Further, by arranging the cylinder for the holding pin in close proximity to the outer circumference of the leg, the bending moment on the pin is further reduced since the unsupported length of the pin is substantially eliminated. Still further, the cylinder surrounding the pin further reduces the bending moment on the pin by providing an upper surface against which the pin abuts.

According to a further aspect of the present invention, three fluid cylinders are operably connected between the platform and the carrier for effecting movement of the carrier relative to the rails. The three fluid cylinders are arranged to partially surround the leg such that imaginary lines joining centers of the cylinders form an isosceles triangle. The base of the triangle is bisected by an imaginary line passing through the apex of the triangle and a longitudinal axis of the leg such that the longitudinal axis does not lie outside the triangle. With this arrangement of the fluid cylinders, the carrier is more evenly balanced to permit easier movement of the carrier along the jack tracks which are closely received within the recesses within the carrier. Further, by providing the cylinders in the above described pattern, the bending moment on the holding pins is further reduced.

According to still a further aspect of the present invention, the fluid cylinders have an extensible and retractable piston disposed therein which piston moves in an extensible direction during both upward movement of the platform relative to the leg and downward movement of the leg relative to the platform. In still a further aspect of the present invention, the frame includes a generally horizontal cross member secured to the vertical side rails with the cross member being vertically spaced from the platform. Further fluid cylinders are operably connected between the cross bar and a further carrier for effecting movement of the further carrier relative to the rails. Third and fourth holding mechanisms supported by the carrier are provided for selectively engaging aligned ones of the openings in the jack tracks to prevent vertical movement of the further carrier relative to the leg.

The further fluid cylinders may be arranged to be selectively extensible and retractable in reverse phase relationship to the first cylinders. In this way, a substantially continuous step-wise jacking operation can be accomplished by the present invention. In other words, by alternating movement between the two carriers in sequence, the jacking operation can be undertaken substantially continuously. Alternatively, all of the fluid cylinders may be arranged to operate in unison to provide an increased lifting force. This increased force is particularly useful when pulling the legs from the water bed or when the platform is heavily loaded.

BRIEF DESCRIPTION OF THE DRAWINGS

Preferred embodiments of the present invention will be described in greater detail with reference to the accompanying drawings, wherein like elements bear like reference numerals and wherein:

FIG. 1 is a perspective view of offshore platform seated upon support legs in a body of water;

FIG. 2 is a schematic view of a portion of one form of support leg with jack tracks according to the present invention secured thereto;

FIG. 3 is a schematic cross-sectional view of the support leg similar to that in FIG. 2 and suitable for supporting a platform of FIG. 1;

FIG. 6 is an enlarged view of a portion of the jacking mechanism of FIG. 5;

FIG. 7 is an enlarged view of a portion of the jacking mechanism of FIG. 4;

FIG. 12 is a schematic cross-sectional view of another form of leg suitable for supporting the platform of FIG. 1;

FIG. 13 is a view of a portion of a supporting leg with another embodiment of a jack track according to the present invention secured thereto; and FIG. 14 is a cross-sectional view of the supporting leg and the jack track taken along the line 14—14 in FIG. 13.

DETAILED DESCRIPTION OF THE PREFERRED EMBODIMENTS

Figure 4:
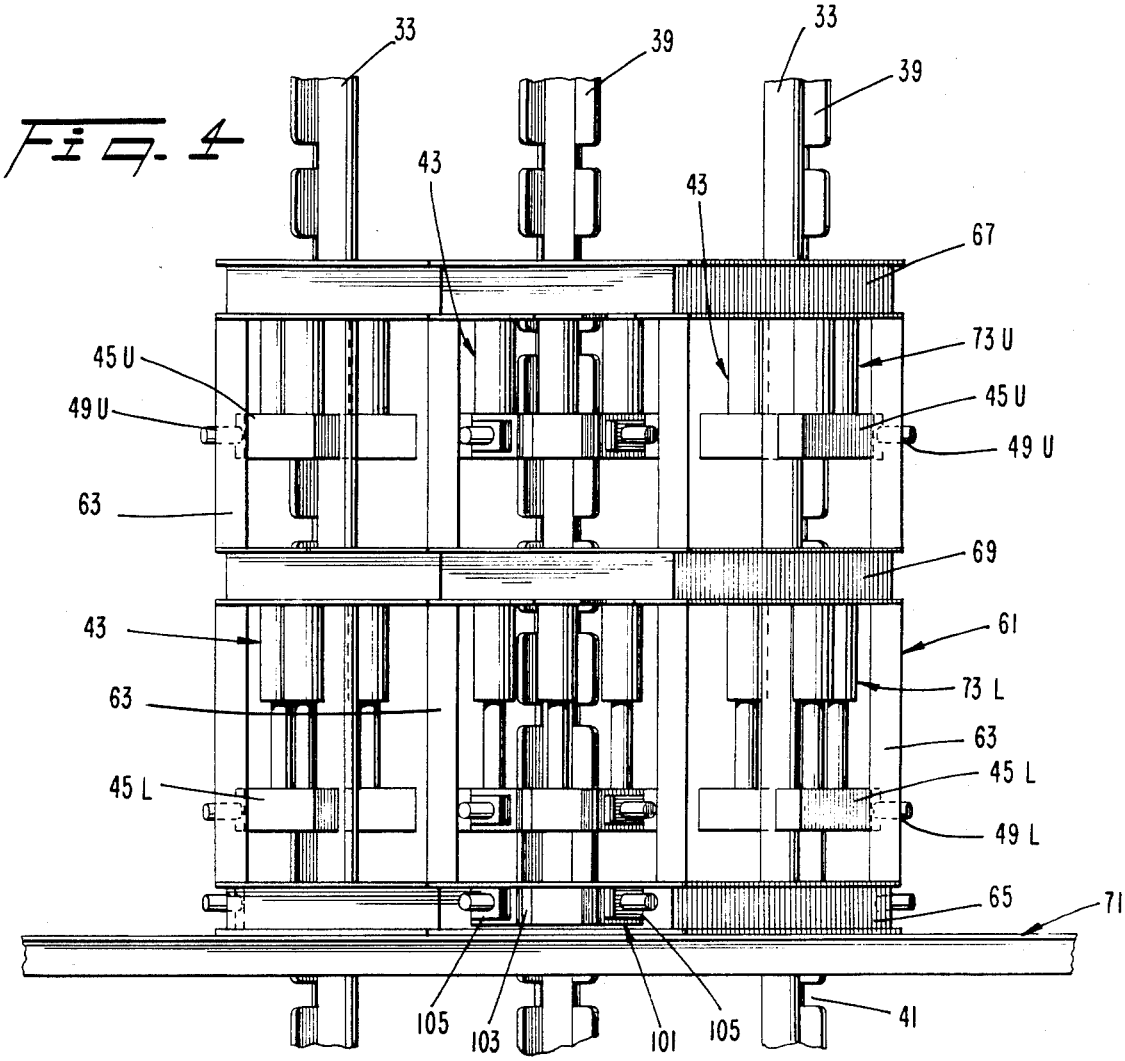
FIG. 4 is a front elevational view of a preferred form of jacking mechanism for effecting relative movement between the platform and the legs in accordance with the present invention.
Figure 5:
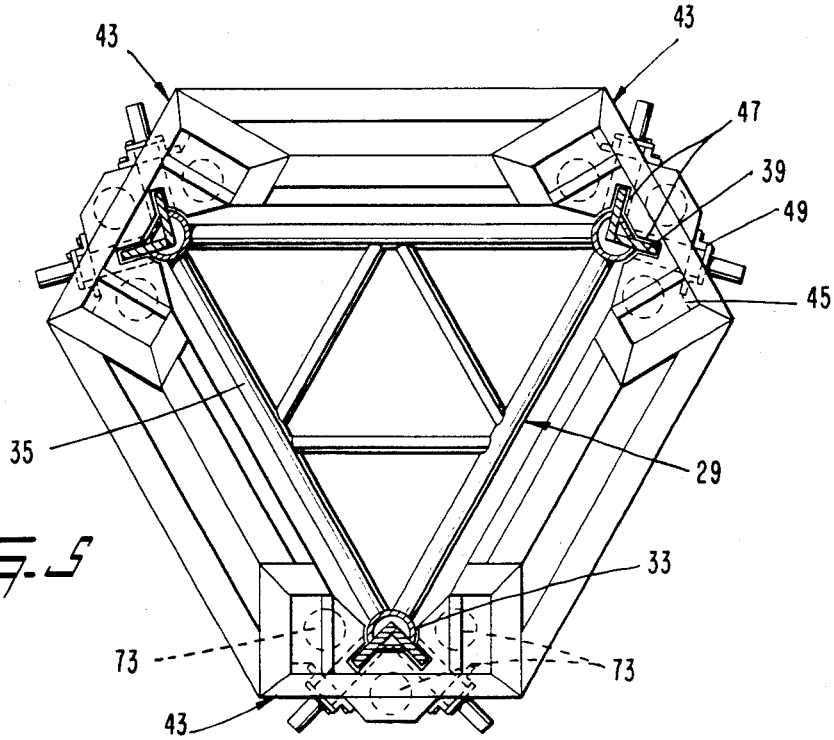
FIG. 5 is a cross-sectional view of a portion of the jacking mechanism.

With reference to FIG. 1, a platform 21, preferably in the form of a floatable barge, is situated in or above a body of water 23. The platform includes a deck 25 capable of carrying appropriate drilling or servicing equipment. Jack houses 27 are located at a plurality of positions on the platform. Upright platform legs 29 extend through a roof 31 of each jack house 27. Each of the legs 29 is capable of vertical movement through the jack house 27.

In normal practice, the platform 21 is floated to the drilling or service site whereupon the legs 29 are jacked down relative to the platform into engagement with the water bed. After the legs 29 firmly engage the water bed, subsequent jacking raises the platform 21 relative to the legs 29 to an elevated position above the water surface free from the action of waves.

The legs 29 may assume various configurations. With reference to FIG. 3, a plurality of upright chord 33 are secured in a triangular orientation by bracing members 35. With reference to FIG. 12, another suitable configuration is a diamond-shaped leg arrangement employing four chord 33 held by suitable bracing members 37. Alternatively, the leg may be comprised of a single large cylindrical column (unillustrated).

With reference to FIG. 2, each of the chord 33 of the support leg 29 is preferably provided with a pair of identical jack tracks 39 secured to the chord 33 by any suitable arrangement, e.g., welded. Each of the jack tracks 39 comprises any elongated member arranged in a substantially vertical orientation along the chord 33. Each of the jack tracks 39 is provided with a plurality of regularly spaced openings 41 extending completely through the jack track 39 in a direction generally along a circumference of the chord 33 of the leg 29. The spacing of the openings 41 is related to the particular form of jacking apparatus employed which apparatus will be described subsequently.

In a preferred embodiment, the two jack tracks 39 secured to a single chord 33 are arranged at substantially a 90° angle with respect to one another (FIG. 3). In the illustrated embodiment of FIG. 3, a pair of jack tracks are secured to each of the chord 33 of the leg 29. In the embodiment of FIG. 12, only two pairs of jack tracks 39 are illustrated. It is to be understood that jack tracks may be provided for each chord 33 if desired.

As shown in FIGS. 2, 3, 5, and 6, the leg chord 33 comprises an elongated generally cylindrical column having a longitudinal opening therein. One of the jack tracks 39 is fixedly secured to each side of the opening, preferably by welding, while the interior ends of the jack tracks 39 are abutted and preferably welded to one another at substantially a 90° angle within the interior of the leg cord 33. With special reference to FIG. 6, a reinforcement plate 79 is preferably welded between the jack tracks 39 to further reinforce the jack tracks 39 against bending relative to the leg chord 33. This arrangement provides a particularly strong mounting for the jack tracks 39 without substantially diminishing the strength of the leg chord 33. Also, jack tracks in such an arrangement can be fabricated from ordinary steels and accordingly are relatively inexpensive to produce.

In a further embodiment of the present invention, and with reference to FIGS. 13 and 14, the jack tracks may be comprised of a plurality of individual sections or segments. Sections 81 are provided with the openings 41' while separate solid sections 83 fill the vertical spaces between the sections 81 to form a continuous, uninterrupted vertical jack track 39'. The solid sections 83 may be made of lighter strength & weight steel than the sections 81 since the solid sections 83 are not subjected to the shear forces developed in the openings 41' thereby reducing costs.

With further reference to FIGS. 13 and 14, the two jack tracks can be formed as a single member if desired and welded directed to the outer circumference of the leg chord. Alternatively, the two jack tracks, either segmented or continuous, could be separately welded together then welded to an outside circumference of the leg chord 33 as a unit. In this manner, the jack tracks can be secured to existing leg cords 33 without requiring and alteration to the chord 33. Openings 85 may be provided in the jack tracks to facilitate welding of the tracks to the outside of the leg chord 33.

As noted previously, and with reference to FIG. 5, the jack houses 27 permit passage of a leg 29 and include a suitable jacking apparatus or mechanism 43 for effecting movement of the leg 29 relative to the platform. A separate jacking apparatus 43 is provided for each of the cords 33 containing a pair of jack tracks 39. Each of the jacking apparatus 43 is arranged to partially encircle the respective chord 33. Only one jacking apparatus will be described since all of the jacking apparatus are substantially identical.

The jacking apparatus 43 includes a carrier block 45 which is adapted for vertical movement along the leg chord 33. The carrier block 45 includes a pair of recesses 47 which closely correspond in configuration with the shape of the jack tracks 39. In other words, the carrier block 45 is adapted to slide along the jack tracks 39 during vertical movement of the carrier block 45. In the illustrated embodiments, the jack tracks 39 have a rectangular horizontal cross section. Accordingly, the recesses 47 are also rectangular. However, it is also contemplated that the jack tracks 39 and the recesses may have an interlocking cross-sectional configuration to further stabilize the carrier block relative to the leg chord 33.

It should be noted that the tolerance surrounding the jack tracks 39 within the recesses 47 is relatively small. Preferably, when jacking is required, the jack tracks 39 are greased to permit easier sliding of the jack tracks 39 within the recesses 47 and the carrier block 45. It should be further noted that due to the 90° orientation of the jack tracks 39 with respect to one another, and the close tolerance between the jack tracks 39 and the recesses 47, the carrier block 45 is held against rotation relative to the leg chord 33 during movement of the carrier block 45 during jacking. The carrier block 45 further includes a pair of holding mechanisms 49 for preventing vertical movement of the carrier block 45 with respect to the leg cord 33 with each of the holding mechanisms 49 cooperating with a respective one of the jack tracks 39.

With reference to FIG. 6, the holding mechanism 49 preferably comprises a pin 51 movable within a cylinder 53. The cylinder 53 extends to the periphery of the carrier block 45 and in close proximity to the circumference to the leg cord 33. Each of the cylinders 53 includes a recess 55 which has a shape which is substantially identical to the shape of the carrier block recesses 47 and, accordingly corresponds to the configuration of the jack tracks 39. In other words, during movement of the carrier block 45 each of the jack tracks 39 passes through both the carrier block 45 and one of the cylinders 53. In a preferred embodiment, the pin 51 is fluidly actuated by a suitable hydraulic actuation system (not shown).

When it is desired to hold the carrier block 45 against vertical movement relative to the leg chord 33, the pin 51 is extended toward the leg chord 33 and is engaged within an aligned opening 41 in the jack track 39. When the pin 51 is extended into the recess 41, a lower surface of the pin rests against an upper surface 59 of the bottom of the opening 41. Since the pin 51 is of a width substantially greater than a width of the jack track 39, the pin is placed in double shear by the jack track 39 with a shear line extending in a substantial U-shaped configuration defined by the periphery of the surface 59 of the opening 41. In other words, the pin 51 bridges the opening 41 in the jack track 39. In this way, the bending moment on the pin 51 is substantially reduced.

By providing the pin in double shear with a comparatively small bending moment, the pin 51 may be ccmprised of substantially lighter and less expensive steel than that required for a pin subjected to shear along a single plane and a significantly higher bending stress. Such a higher bending stress would be induced upon the holding pin if the pin was inserted directly into a hole or opening within the chord 33 or if the opening in the track was wider than the pin. Further, since the pin is still arranged within the cylinder 53, the bending moment induced on the pin 51 during engagement in the openings 41 is further reduced. That is, the pin 51 is still supported by the upper walls of the cylinder 53. Still further, since the cylinder 53 is in close proximity to the circumference of the leg chords 33, the unsupported length of the pin 51 is negligible thereby further reducing the bending moment on the pin 51.

In addition, the force on the jack track is distributed over the entire surface area 59 of the opening 41. Due to the relatively large surface area of the surface 59, the jack track itself can be made of substantially lighter steel than the steel required if the jack track was subjected to a force along substantially a single shear line as in a opening within a hollow jack track member. In addition, the force is distributed over the surface areas of the two tracks 39 rather than a single track or opening. Accordingly, the required yield strength of the tracks 39 is further reduced. Since the jack tracks are not subjected to a substantial bending moment due to the configuration of the holding pins 51, the strength required for segments 81, 83 (FIGS. 13 and 14) or the single piece jack tracks 39 is not as great as that required for tracks which are subject to substantially larger bending moments. This reduction in material costs for both the holding pins 51 and the tracks 39 occasioned by the arrangement according to the present invention is very significant particularly when the platform 21 contains several legs 29 each containing three or four leg cords 33.

With reference to FIG. 4, the appropriate number of jacking mechanisms 43 for the particular leg construction are contained within an integral support frame structure 61 including at least two generally vertical side rails 63 secured together by a lower frame rail 65 and an upper frame rail 67. In the illustrated embodiment, three jacking apparatus 43 are shown. In a preferred embodiment, a cross member 69 is secured to the side rails 63 generally centrally between the upper and lower frame rails 65, 67. The frame unit 61 is secured to a lower floor 71 of the jack house 27 which lower floor is rigidly secured to the platform 21. The entire frame structure 61 is preferably comprised of steel which is welded securely together to form an integral fabricated unit.

In the preferred embodiment, each of the jacking apparatus 43 includes upper and lower carrier blocks 45U and 45L, respectively. Each of the carrier blocks is similar to the carrier block 45 described above and is adapted for movement relative to the side rails 63 and the respective chord 33. Movement of the upper carrier block 45U and the lower carrier block 45L is preferably effected by upper hydraulic cylinders 73U and lower hydraulic cylinders 73L, respectively. Each of the cylinders 73U, 73L includes an extensible and retractable piston member. The upper cylinders 73U are secured between the upper frame rail 67 and the upper carrier block 45U while the lower cylinders 73L are secured between the cross member 69 and the lower carrier block 45L.

Each of the carrier blocks 45U, 45L contain a pair of holding mechanisms 49U, 49L, respectively, which are similar to the holding mechanism 49 described previously. The spacing between the openings 41 in the jack tracks 39 is determined by the stroke of the cylinders 73U, 73L. In other words, a full stroke of the cylinder will move the respective carrier block from a first location in which the holding mechanism can engage one of the openings 41 in the jack track 39 to a second location in which the holding mechanism can engage the next opening 41 in the jack track immediately above or below the first location depending upon the direction of movement of the carrier block 45. It should be noted that the opening 41 has a vertical height which is substantially larger than the vertical height of the holding pin 51 to permit easier insertion and withdrawal of the pin 51 in the opening 41. The relative heights of the pins 51 and the openings 41 do not have to be too close since the pin 51 is supported flush against the opening surface 59. This reduced criticality in cutting the appropriate openings 41 further reduces the cost of producing the jack tracks 39 according to the present invention.

In the preferred embodiment and with reference to FIG. 6, three hydraulic cylinders 73 are provided for effecting movement of each carrier block 45 along the respective leg chord 33. The three cylinders 73 are arranged such that imaginary lines (indicated by dot-dash lines) joining the centers of the three cylinders 73 form an isosceles triangle. It is noted that the imaginary triangle may also be an equilaterial triangle which is merely a special form of isosceles triangle. The base 74 of the triangle is bisected by an imaginary line passing through the apex of the triangle 75 (coincident with one of the cylinders 73) and a central, longitudinal axis 77 of the cord 33. In a preferred embodiment of the present invention, the central axis 77 of the leg chord 33 is coincident with the base 74 of the imaginary triangle. However, the base of the imaginary triangle may be arranged such that the central axis 77 lies within the perimeter of the imaginary triangle.

By arranging the cylinders 73 in such a orientation, the bending forces exerted upon the leg chord 33 during movement of the carrier block 45 are minimized. Further, by arranging the cylinders 73 in the surrounding triangular orientation, movement of the carrier block 45 is greatly facilitated along the jack tracks 39. In other words, the weight of the carrier block 45 is more evenly distributed around the leg chord 33 so that twisting or cocking of the carrier block 45 is minimized. The twisting or cocking could cause the jack tracks 39 to bind within the closely spaced recesses 47.

Still further, by arranging the central axis of one of the cylinders 73 at the apex of the imaginary isosceles triangle, the bending moment upon the holding pins 51 is further reduced. The reduction in bending moment is due to the fact that each of the imaginary lines forming the legs of the isosceles triangle are arranged to intersect respective openings 41 in a respective one of the jack tracks 39. In this way, when the pin 51 is engaged within the opening 41 in the jack track 39, the pin 51 is intersected by the respective leg of the triangle and accordingly is subjected to substantially only shear stress. In other words, since the pin carrier block 45, and consequently the cylinders 53 and pins 51, is supported along lines passing through the openings 41, the bending stress to which the pins 51 are subjected is further minimized. In addition, the carrier block 45 itself is more evenly balanced for movement along the jack tracks 39 which are in close tolerance with the recesses 55 in the cylinder and the recesses 47 in the carrier block 45 to prevent binding within the recesses.

Returning briefly to FIG. 4, an auxiliary holding mechanism 101 includes a carrier block 103 arranged on the base rail 65 of the frame unit 61. The carrier block 103 includes a holding mechanism 105 similar to the holding mechanism 49 described previously. The auxiliary carrier block 103 is preferably adjustable within small limits along the side rails 63 to ensure that the holding mechanism 105 can be engaged within an opening 41. The auxiliary holding mechanism 101 is generally engaged when jacking is not required in order to relieve the load on the holding pins 51 and to provide a safety latching mechanism to ensure against unwanted movement of the platform 21 relative to the legs 29.

Figure 9:
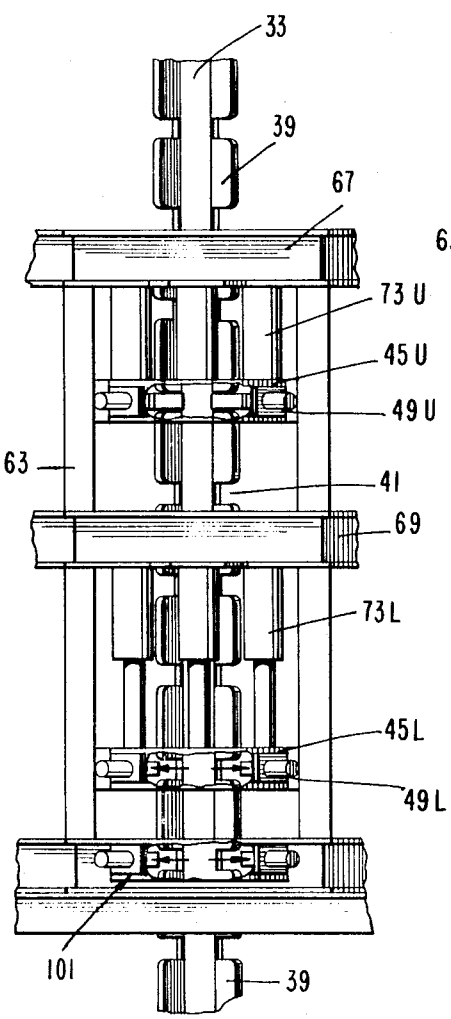
Figure 8:
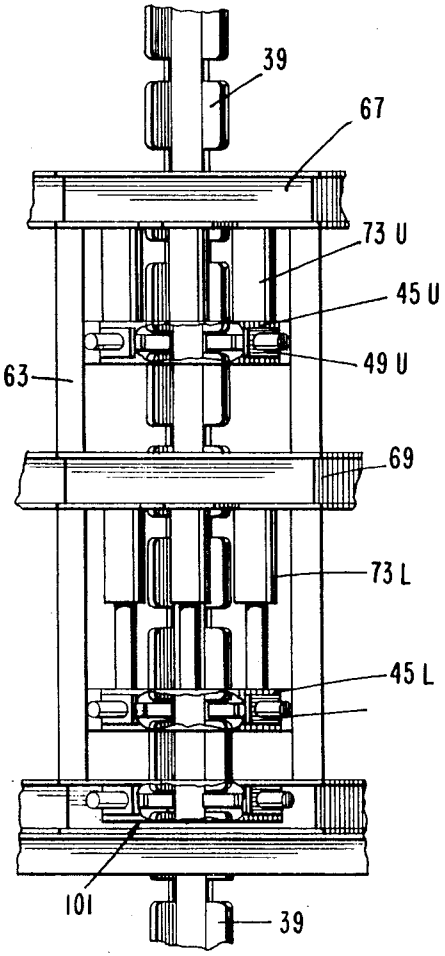

One form of operation of the jacking mechanism according to the present invention will be described with reference to FIGS. 8–11 which illustrate a portion of the steps undertaken for the jacking operation. With reference to FIG. 8, in a stationary position of the platform 21, the holding mechanisms 49L, the holding mechanisms 49U and the auxiliary holding mechanism 101 are each engaged with the jack tracks 39. When it is desired to begin the jacking operation, the holding mechanisms 49L and the auxiliary holding mechanisms 101 are retracted thereby leaving the platform supported by the holding mechanisms 49U (FIG. 9).

Figure 11:
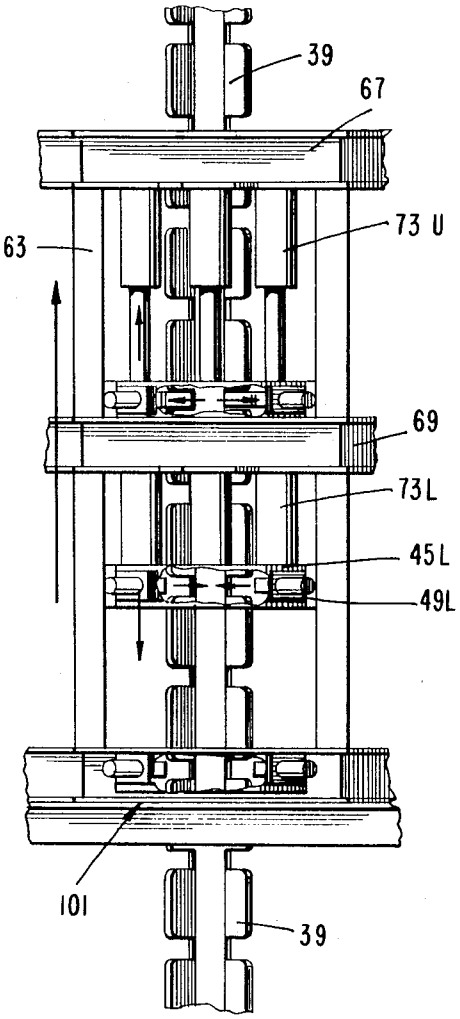
FIG. 8–11 are sequential schematic views illustrating the operation of the jacking mechanism according to the present invention.
Figure 10:
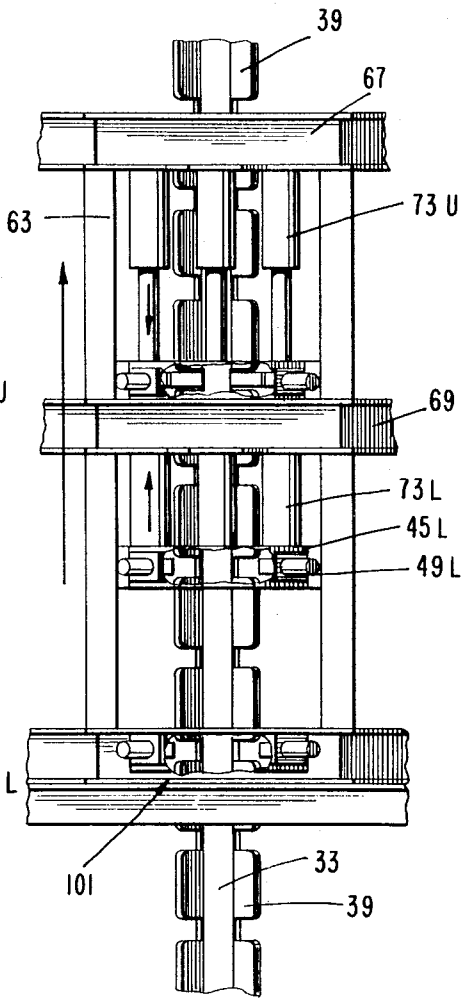

The cylinders 73U are power extended such that the upper frame section 67 is forced upwardly due to the engagement of the holding mechanisms 49U within aligned openings 41 within the jack tracks 39 (FIG. 10). Simultaneously with the extension of the upper cylinders 73U, the lower cylinders 73L are retracted thereby raising the carrier block 45L upwardly along the jack tracks 39. Upon full extension of the upper cylinders 73U and complete retraction of the lower cylinders 73L, the lower holding mechanism 49L are engaged within the aligned openings 41 within the jack tracks 49 (FIG. 11). Substantially simultaneously therewith, the upper holding mechanisms 49U are disengaged from the respective openings 41 within the jack tracks 39 (FIG. 11).

At this time, the lower cylinders 73L are extended while the upper cylinders 73U are retracted. The extension of the lower cylinders 73U causes the cross beam 69 to move upwardly along the leg 29 due to the engagement of the lower holding mechanisms 49L with the cords 33. Since the cross beam 69 is rigidly connected to the side rails 63, the entire frame unit 61 moves upwardly.

Upon complete extension of the lower cylinders 73L and the complete retraction of the upper cylinders 73U, the upper holding mechanisms 49U are again engaged within the aligned openings 41 in the jack tracks 39 and the lower holding mechanisms 49L are disengaged from the respective jack tracks 39. At this point, the operation begins anew. In other words, the upper and lower cylinders and holding mechanisms operate in reverse phase relationship to one another. Accordingly, the apparatus according to the present invention provides a substantially continuous lifting of the platform relative to the legs 29. The time required to move the various sets of holding mechanisms into and out of engagement with the tracks 39 is minimal. In other words, while the operation is somewhat step-like, the time delay between each step approaches zero. The insertion and withdrawal of the pins 51 within the openings 41 is facilitated since the height of the openings is greater than the height of the pins 51.

It should be noted that each of the cylinders 73 is in the extension mode when raising the platform 21 relative to the leg 29. In this way, due to the increased surface area of the internal piston within the cylinder 73 during extension, maximum force can be utilized to raise the platform. By utilizing the cylinders in the extensible mode when under load, the cost of each cylinder is reduced compared to the cost of utilizing these cylinders in a retraction mode to provide the lifting force for the platform. Accordingly, the equipment cost in cylinders is reduced. It should further be noted that a similar analysis applies, i.e., the cylinders act in the extensible mode when moving the leg 29 downwardly relative to the platform 21 toward the water bed or ocean floor.

Alternatively, the upper and lower cylinder 73U, 73L may be arranged to operate in unison thereby effectively doubling the lifting force obtainable. This increased force may be required, for example, when raising the legs 29 from the water bed after completing the required drilling or servicing. It should be noted that when raising the legs 29 from the water bed, the cylinders 73U, 73L are operating in the retractable mode. In other words, the force developed by each cylinder is less than the force developed in the extensible mode and accordingly, the increased force occasioned by the unison operation of the cylinders may be required. Unison operation of the cylinders may also be required if the platform 21 is heavily loaded with machinery or other materials.

The principles, preferred embodiments and mode of operation of the present invention have been described in the foregoing specification. However, the invention which is intended to be protected is not to be construed as limited to the particular embodiments disclosed. The embodiments are to be regarded as illustrative rather than restrictive. Variations and changes may be made by others without departing from the spirit of the present invention. Accordingly, it is expressly intended that all such variations and changes which fall within the spirit and scope of the present invention as defined in the claims be embraced thereby.

What is claimed is:

1. Jacking apparatus for effecting relative vertical movement between an upright leg having at least one vertical chord and defining an upright vertical column and a platform, comprising:

frame means for mounting on the platform, said frame means including at least two generally parallel vertical side rails;

first carrier means movably carried by said frame means for vertical movement relative to said rails; said carrier means being adjacent to said upright leg;

a first fluid cylinder means operably connected between said platform and said carrier means for effecting movement of said carrier means relative to said rails;

first and second elongated jack tracks fixedly secured in a generally vertical orientation to at least said one chord, each of said jack tracks being received within a correspondingly shaped recess in said carrier means, the orientation of the tracks and the recesses permitting only vertical movement of the carrier means relative to the tracks;

each of said jack tracks includes a plurality of regularly spaced openings extending completely through said jack track in a direction generally parallel to a circumference of said chord;

first and second holding means defining a pair of holding means supported by said carrier means for selectively engaging an aligned one of said openings in the first and second jack tracks respectively to prevent vertical movement of said carrier means relative to said chord; and said pair holding means has a width which exceeds a width of the openings in said jack tracks in a direction parallel to the circumference of said chord.

2. The jacking apparatus according to claim 1, wherein each of said holding means comprises a pin movably mounted within an open-ended cylinder supported by said carrier means, said open-ended cylinder including said recess and extending to a location closely adjacent an outer circumferential surface of a pair of track engaging openings located in a single plane, said openings extending substantially 90° from each other.

3. The jacking apparatus according to claim 1, wherein the first and second jack tracks are arranged at an angle of substantially 90° relative to one another so as to form a pair of openings in a single plane across said angle.

4. The jacking apparatus according to claim 1 or 3, wherein the chord comprises an elongated, partial cylindrical column having a longitudinal opening, with said jack tracks being fixedly secured to each side of said chord opening at a 90° angle.

5. The jacking apparatus according to claim 4, further comprising a reinforcement plate fixedly secured between said jack tracks so as to define the leg chord as a substantially strong support member of said upright leg.

6. The jacking apparatus according to claim 1 or 3 wherein said jack tracks are fixedly secured to one another and are fixedly secured to an outside circumference of said chord so as to define an elongated column which forms a leg chord.

7. The jacking apparatus according to claim 1, wherein each of the jack tracks comprises a plurality of individual sections forming a continuous uninterrupted vertical track along said cored extending at a 90° angle from the upright vertical column and defining openings for engagement by a carrier element, said openings located in parallel planes with engagement pins, said pins actuated for engagement with said openings.

8. The jacking apparatus according to claim 1, wherein each of said jack tracks has a rectangular horizontal cross section so as to provide a substantially strengthened vertical leg chord.

9. The jacking apparatus according to claim 1, wherein each of the tracks and the corresponding recess have interlocking cross-sectional bracing configurations between the jack tracks which extend at a 90° degree angle from the chord center.

10. The jacking apparatus according to claim 1, wherein the vertical height of the track openings is larger than the vertical height of an individual holding pin engagement means.

11. The jacking apparatus according to claim 1, wherein the slide tolerance between the recesses in the carrier means and the corresponding jack track is minimized.

12. The jacking apparatus according to claim 1, wherein a generally U-shaped shear line exits between each of the holding means when the holding means engages the pair of jack track openings in unison in a single plane.

13. The jacking apparatus according to claim 1, further comprising a generally horizontal cross member secured to said vertical side rails, said cross member being vertically spaced from said platform;

second carrier means movably carried by said frame means for vertical movement relative to said rails, said further carrier means being adjacent to said cord and receiving said jack tracks within correpondingly shaped recesses as the first carrier means;

a second fluid cylinder means operably connected between said cross member and said second carrier means for effecting movement of said second carrier means relative to said rails and said leg chord;

third and fourth holding means supported by said further carrier means for selectively engaging an aligned pair of said openings in the first and second jack tracks respectively to prevent vertical movement of said second carrier means relative to said chord; and said second cylinder means being selectively extensible and retractable in reverse phase relationship to said cylinder means, and said third and fourth holding means being selectively engagable and disengagable with said openings in reverse phase relationship to said first and second holding means on the jack track, said third and fourth holding means operating in alternate sequence to said first fluid cylinder means.

14. The jacking apparatus according to claim 1 to 13, further comprising auxiliary holding means operably independently of said holding means, said auxiliary holding means being arranged on said frame and being selectively in alignment with said pair of jack track openings to prevent further movement of said leg relative to said platform.

15. Jacking apparatus for effecting relative vertical movement between an upright leg and a platform, comprising:

frame means for mounting on said platform, said frame means including at least two generally parallel vertical side rails;

carrier means movably carried by said frame means for vertical movement relative to said rails, said carrier means being adjacent to said leg;

three fluid cylinder means operably connected between said platform and said carrier means for effecting movement of said carrier means relative to said rails;

said three fluid cylinders arranged to partially surround said leg such that imaginary lines joining centers of the cylinders form an isosceles triangle;

the base of said triangle being bisected by an imaginary line passing through the apex of the triangle and a central longitudinal axis of said leg such that said central axis does not lie outside of the imaginary triangle; and holding means for selectively coupling said carrier means to said leg to prevent vertical movement of said carrier means relative to said leg.

16. The jacking apparatus according to claim 15, further comprising:

first and second jack tracks fixedly secured in a generally vertical orientation to said leg, each of said jack tracks including a plurality of regularly spaced openings extending completely through said jack tracks in a direction along a circumference of said leg;

said holding means comprising first and second pins for selectively engaging said openings in said first and second jack tracks respectively; and each of the imaginary lines forming the legs of the isosceles triangle intersects a respective pin when the pin is engaged within one of the openings in one of said jack tracks.

17. The apparatus of claim 16, wherein a width of each of the pins exceeds a width of the openings in said jack tracks in the circumferential direction of said leg.

18. The apparatus according to claim 1 or 15, wherein each of said fluid cylinder means comprises a cylinder having an extensible and retractable piston disposed therein, said piston moving in an extensible direction during both upward movement of said platform relative to said leg and downward movement of said leg relative to said platform.

19. Jacking apparatus for effecting relative vertical movement between an upright leg having at least one vertical chord defining a cylindrical column and a platform, comprising:

frame means for mounting on the platform, said frame means including at least two generally parallel vertical side rails;

first carrier means movably carried by said frame means for vertical movement relative to said side rails, said first carrier means being adjacent facing upright leg chords;

first fluid cylinder means operably connected between said platform and said first carrier means for effecting movement of said first carrier means relative to said rails and leg chord;

first and second elongated jack tracks fixedly secured in a generally vertical orientation to at least said one leg chord, each of said jack tracks being received within a correspondingly shaped recess in said first carrier means, the orientation of the tracks and the recesses permitting only vertical movement of the first carrier means relative to the tracks and extending at a 90° degree angle from a centerline of the leg chord;

each of said vertical jack tracks includes a plurality of regularly spaced openings extending completely through said jack track in a direction generally parallel to a circumference of said leg chord;

first and second holding means supported by said first carrier means for selectively engaging an aligned one of said openings in the first and second jack tracks respectively to prevent vertical movement of said first carrier means relative to said cord;

a horizontal cross member secured to said vertical side rails, said cross member being vertically spaced from said platform and said first carrier means;

second carrier means movably carried by said frame means for vertical movement relative to said rails and said leg chord, said carrier means being adjacent to said leg chord and receiving said jack tracks within correspondingly shaped recesses located in the same plane;

second fluid cylinder means operably connected between said cross member and said second carrier means for effecting movement of said second carrier means relative to said rails and said leg chords;

third and fourth holding means acting in pairs supported by said second carrier means for selectively engaging aligned pairs of said openings in the first and second jack tracks respectively to prevent vertical movement of said second-carrier means relative to said leg chords;

said second fluid cylinder means being selectively extensible and retractable in reverse phase relationship to said first fluid cylinder means, and said third and fourth holding means being selectively engagable and disengagable in pairs with said openings in reverse phase relationship to said first and second holding means which operate in pairs; and each of said first fluid cylinder means and said second fluid cylinder means comprises a cylinder having an extensible and retractable piston disposed therein, said piston moving in an extensible direction during both upward movement of said platform relative to said leg and downward movement of said leg relative to said platform.

* * * * *